US005403105A

United States Patent [19]

Jameson

[11] Patent Number: 5,403,105

[45] Date of Patent: Apr. 4, 1995

[54] TOOTHBRUSH WITH PLURAL SUPPLY

[76] Inventor: King D. Jameson, 1224 Riverside Dr., Huron, Ohio 44839

[21] Appl. No.: 108,231

[22] Filed: Aug. 19, 1993

[51] Int. Cl.[6] ..... A46B 11/02

[52] U.S. Cl. ..... 401/45; 401/47; 401/176; 401/268; 401/291

[58] Field of Search ..... 401/176, 268, 291, 290, 401/190, 45, 47

[56] References Cited

U.S. PATENT DOCUMENTS

| | | | |
|---|---|---|---|
| 924,469 | 6/1909 | Johnson | 401/176 |
| 1,584,566 | 5/1926 | Lapierre | 401/290 X |
| 2,377,837 | 6/1945 | Zimmermann | 401/176 |
| 5,020,694 | 6/1991 | Pettengill | 401/176 X |
| 5,088,850 | 2/1992 | Taichman et al. | 401/176 |

FOREIGN PATENT DOCUMENTS

| | | | |
|---|---|---|---|
| 263617 | 12/1949 | Switzerland | 401/173 |
| 1746 | of 1898 | United Kingdom | 401/291 |
| 1181305 | 2/1970 | United Kingdom | 401/190 |
| 2175798 | 12/1986 | United Kingdom | 401/176 |

*Primary Examiner*—Steven A. Bratlie
*Attorney, Agent, or Firm*—Hugh E. Smith

[57] ABSTRACT

The present invention relates to a toothbrush with a detachable dentifrice dispenser assembly. The brush includes a head portion with a centrally located aperture. The aperture communicates with a corresponding aperture located within the detachable dentifrice dispenser. The dispenser is adapted to be removably secured on the bottom surface of the toothbrush. In alternate embodiments, a plunger assembly is located in association with the dispenser to facilitate the dispensing of the dentifrice through the aperture in the head portion and into the bristles of the brush. Alternatively, the dispenser assembly can be removed and dentifrice can be delivered directly from the container through the head aperture and into the bristles of brush.

1 Claim, 4 Drawing Sheets

TOOTHBRUSH WITH PLURAL SUPPLY

BACKGROUND OF THE INVENTION

1. Field of the Invention

The present invention relates to a toothbrush with a dentifrice dispenser and more particularly pertains to a dentifrice dispenser which may be detachably coupled to the bottom surface of the toothbrush head.

2. Description of the Prior Art

The use of dentifrice dispensing toothbrushes is known in the prior art. More specifically, toothbrushes heretofore devised and utilized for the purpose of dispensing dentifrice are known to consist basically of familiar, expected and obvious structural configurations, notwithstanding the myriad of designs encompassed by the crowded prior art which have been developed for the fulfillment of countless objectives and requirements.

For example, a toothbrush and paste dispenser device is illustrated in U.S. Pat. No. 5,066,155. This patent illustrates a toothpaste dispenser unit having a brush head with a longitudinally extending toothpaste receiving and dispensing opening provided therein, and a disposable toothpaste receiver and dispenser cartridge which engages the brush head and connects to the opening in the brush head.

A dentifrice dispensing toothbrush is described in U.S. Pat. No. 4,787,765. The patent illustrates a toothbrush which stores dentifrice material in its handle and deposits a controlled quantity of the stored material directly onto the top of the brush surface.

A dispenser toothbrush is described in U.S. Pat. No. 4,733,983. The patent illustrates a fillable toothbrush provided with a handle containing a dispenser for toothpaste.

Another patent of interest is U.S. Pat. No. 5,062,728 which illustrates a dentifrice dispensing toothbrush. The toothbrush includes a housing, a reservoir situated within the housing body and a removable cartridge positioned within the reservoir for storing dentifrice material.

Yet another patent of interest is U.S. Pat. No. 4,277,194. This patent illustrates a paste dispensing toothbrush. The toothbrush includes a polishing paste compartment and a plunger for forcing paste through a passageway.

While these brushes fulfill their respective, particular objectives and requirements, the aforementioned patents do not describe a dentifrice dispensing toothbrush wherein the dispensing is achieved through a detachable dispenser secured to the bottom surface of the toothbrush. Additionally, the prior art brushes do not include such a dispenser which is capable of dispensing a plurality of pastes and/or gels in individually measured amounts. Furthermore, the prior art does not illustrate a toothbrush which is specifically designed to be coupled with a container of dentifrice such that the paste or gel can be delivered directly to the bristles of the toothbrush.

In this respect, the dentifrice injector brush according to the present invention substantially departs from the conventional concepts and designs of the prior art, and in so doing provides an apparatus primarily developed for the purpose of dispensing dentifrice into a toothbrush.

Therefore, it can be appreciated that there exists a continuing need for new and improved brushes which can be used for injecting dentifrice. In this regard, the present invention substantially fulfills this need.

SUMMARY OF THE INVENTION

In view of the foregoing disadvantages inherent in the known types of toothbrushes with dentifrice dispensers now present in the prior art, the present invention provides an improved injector brush construction wherein the same can be utilized for dispensing dentifrice more conveniently, efficiently, and economically. As such, the general purpose of the present invention, which will be described subsequently in greater detail, is to provide a new and improved injector brush apparatus and method which has all the advantages of the prior art brushes and none of the disadvantages.

To attain this, the present invention essentially comprises a toothbrush adapted for connection with a container of dentifrice, the toothbrush comprising a handle portion having a forward end and a rearward end, a bottom surface and a top surface; a head portion having a forward end, a rearward end, a top surface and a bottom surface, the rearward end of the head portion being integral with the forward end of the handle portion, an aperture located within the head portion, the aperture having a lower section and an upper section; a generally conically shaped surface forming the lower section of the aperture, the generally conically shaped surface adapted for engagement with a container of dentifrice; a cylindrical surface forming the upper section of the aperture and forming an extension of the generally conically shaped aperture; and a plurality of bristles, the bristles having an upper extent and a lower extent, the lower extent of the bristles being attached to the top surface of the head portion and surrounding the cylindrical surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved injector brush which has all the advantages of the prior art brushes and none of the disadvantages.

It is another object of the present invention to provide a new and improved injector brush which may be easily and efficiently manufactured and marketed.

It is a further object of the present invention to provide a new and improved injector brush which is of a durable and reliable construction.

An even further object of the present invention is to provide a new and improved injector brush which is susceptible of a low cost of manufacture with regard to both materials and labor, and which accordingly is then susceptible of low prices of sale to the consuming public, thereby making such injector brushes economically available to the buying public.

Still yet another object of the present invention is to provide a new and improved injector brush which provides in the apparatuses and methods of the prior art some of the advantages thereof, while simultaneously overcoming some of the disadvantages normally associated therewith.

Still another object of the present invention is to provide a new and improved toothbrush adapted for connection with a container of dentifrice, the toothbrush comprising a handle portion having a forward end and a rearward end, a bottom surface and a top surface; a head portion having a forward end, a rearward end a top surface and a bottom surface, the rearward end of the head portion being integral with the forward end of the handle portion, and aperture located within the head portion; a plurality of bristles, the bristles having an upper extent and a lower extent, the lower extent of the bristles being attached to the top surface of the head portion and surrounding the aperture.

Yet another object of the present invention is to configure a toothbrush for receiving a dentifrice from the back of the head.

Even still another object of the present invention is to inject toothpaste, gel or the like into contact with the bristles of a toothbrush through a conical hole in the head of the toothbrush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
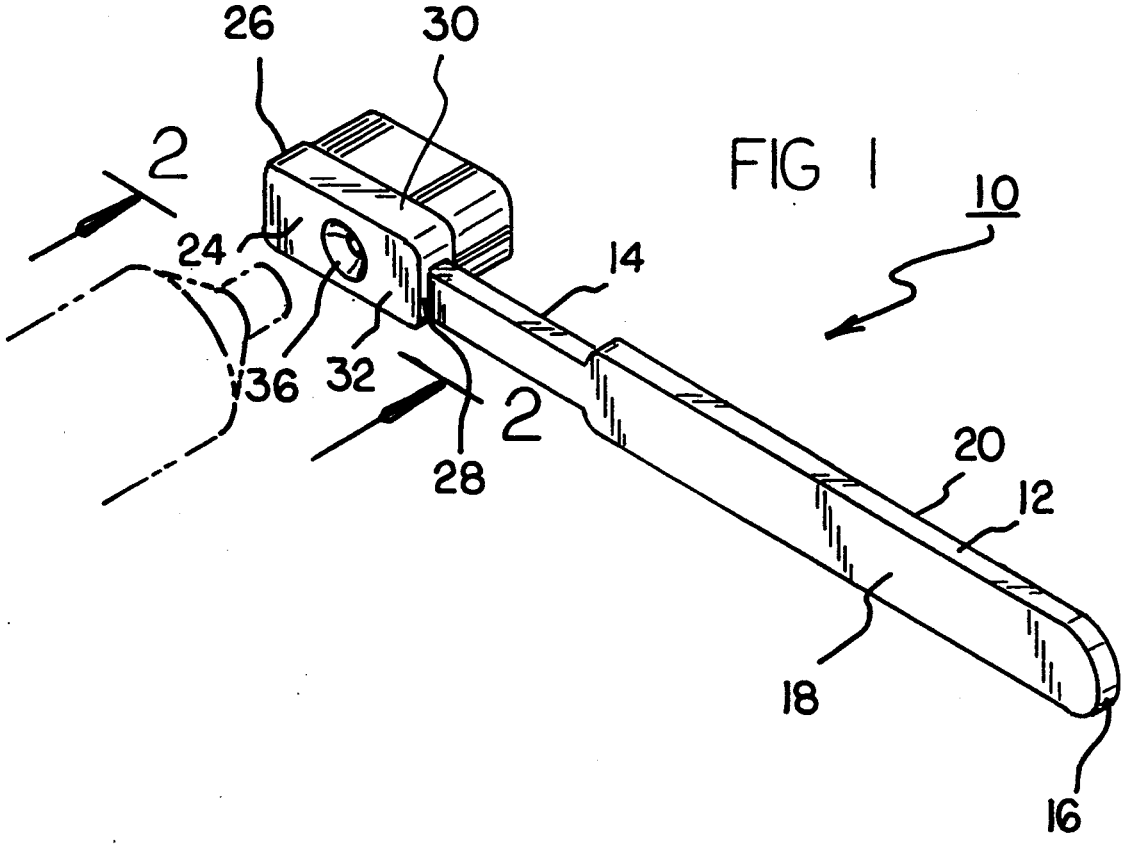
FIG. 1 is a perspective view of a toothbrush constructed in accordance with the primary embodiment of the present invention.
Figure 2:
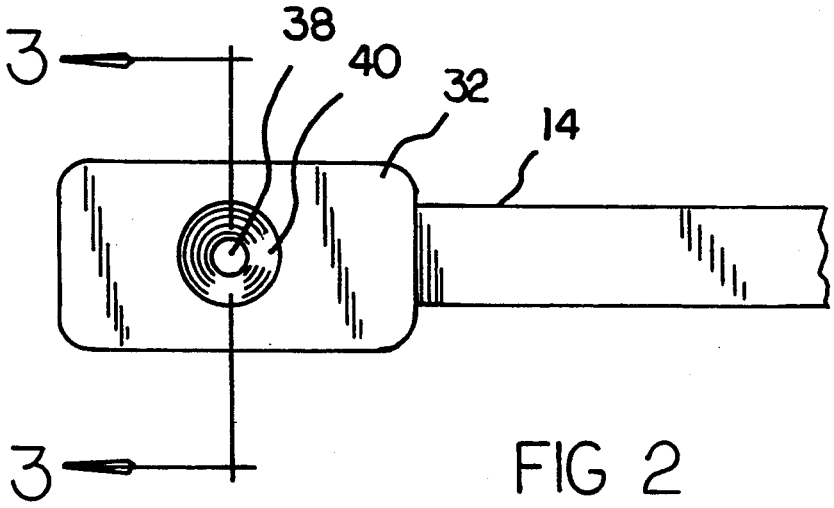
FIG. 2 is a plan view of the head portion of the brush in accordance with the primary embodiment.
Figure 3:
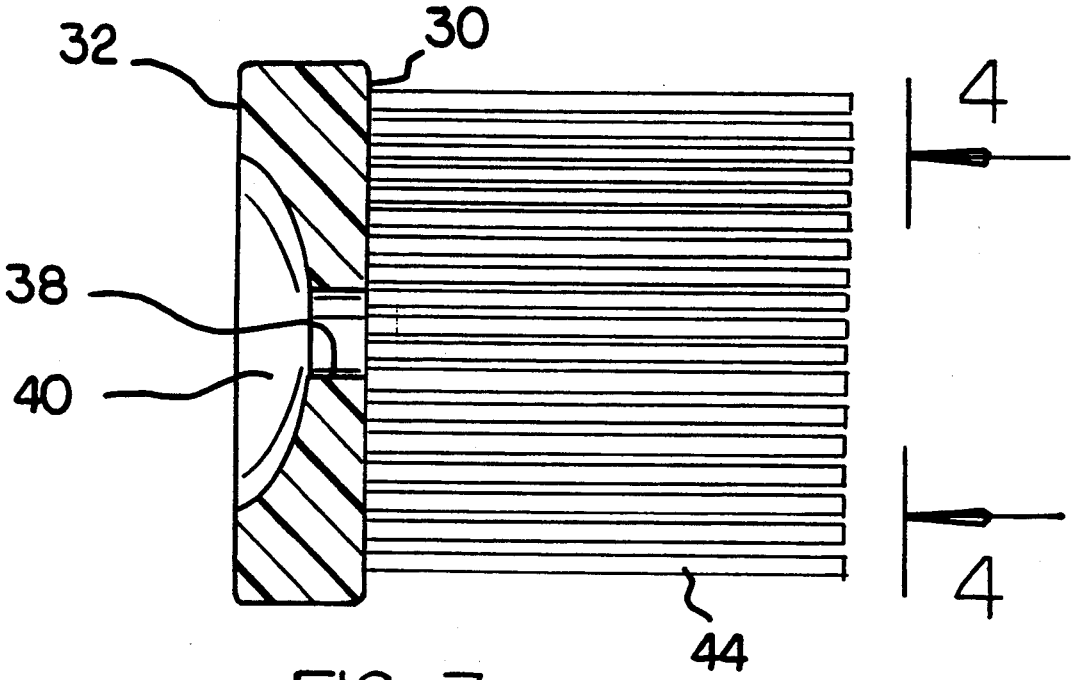
FIG. 3 is a sectional view of the head portion taken through line 3—3 of FIG. 2.
Figure 4:
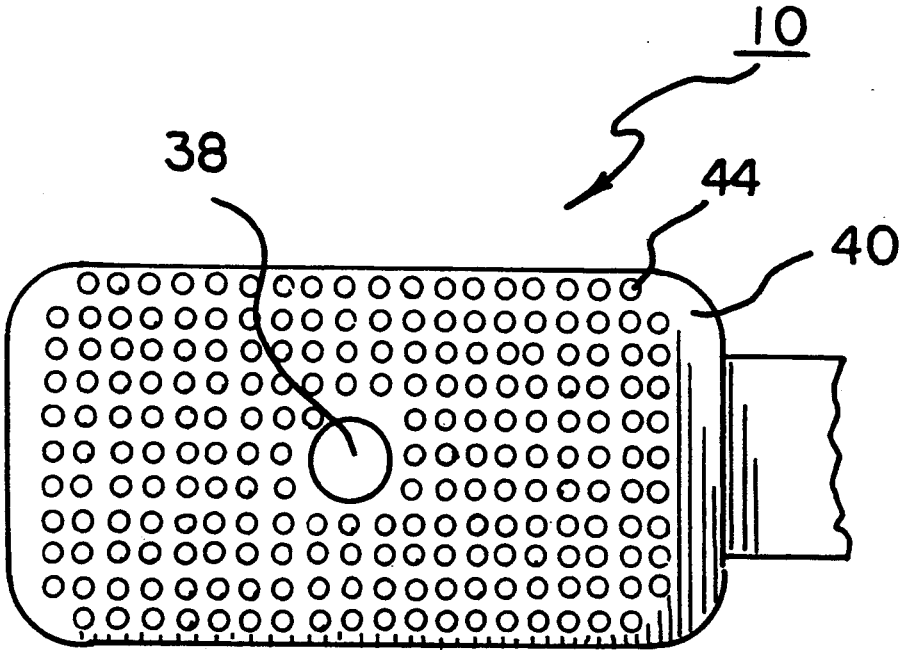
FIG. 4 is a sectional view of the head portion taken through line 4—4 of FIG. 3.

With reference now to the drawings, and in particular to FIG. 1 thereof, a new and improved toothbrush embodying the principles and concepts of the present invention and generally designated by the reference numeral 10 will be described.

The toothbrush 10 of the present invention includes a handle portion 12 having a forward end 14, a rearward end 16, a bottom surface 18, and a top surface 20.

Integral with the forward end 14 of the handle portion 12 is the head portion 24. The head portion includes a forward end 26, a rearward end 28, a top surface 30, and a bottom surface 32. A circular aperture 36, comprising an upper section 38 and a lower section 40, is formed centrally within the head. The upper section 38 of the aperture is cylindrical in shape and extends up from the top surface 30 through approximately half of the thickness of the head. The lower section 40 is generally conical in shape and extends from the termination of the upper section 38 to the bottom surface 32 of the head 24. The diameter of the upper section 38 is approximately half that of the widest part of the lower section 40.

The toothbrush bristles 44 are attached to the top surface 30 of the head portion 24 and extend upwardly therefrom. The bristles are of a conventional construction and surround the circular aperture 36 of the head portion 24.

In this primary embodiment, no dispenser is used in conjunction with the toothbrush as in the following embodiments. The dentifrice or gel is injected directly from its container, through the aperture 36 in the head portion 24, and into the bristles 44.

Figures 5, 6:
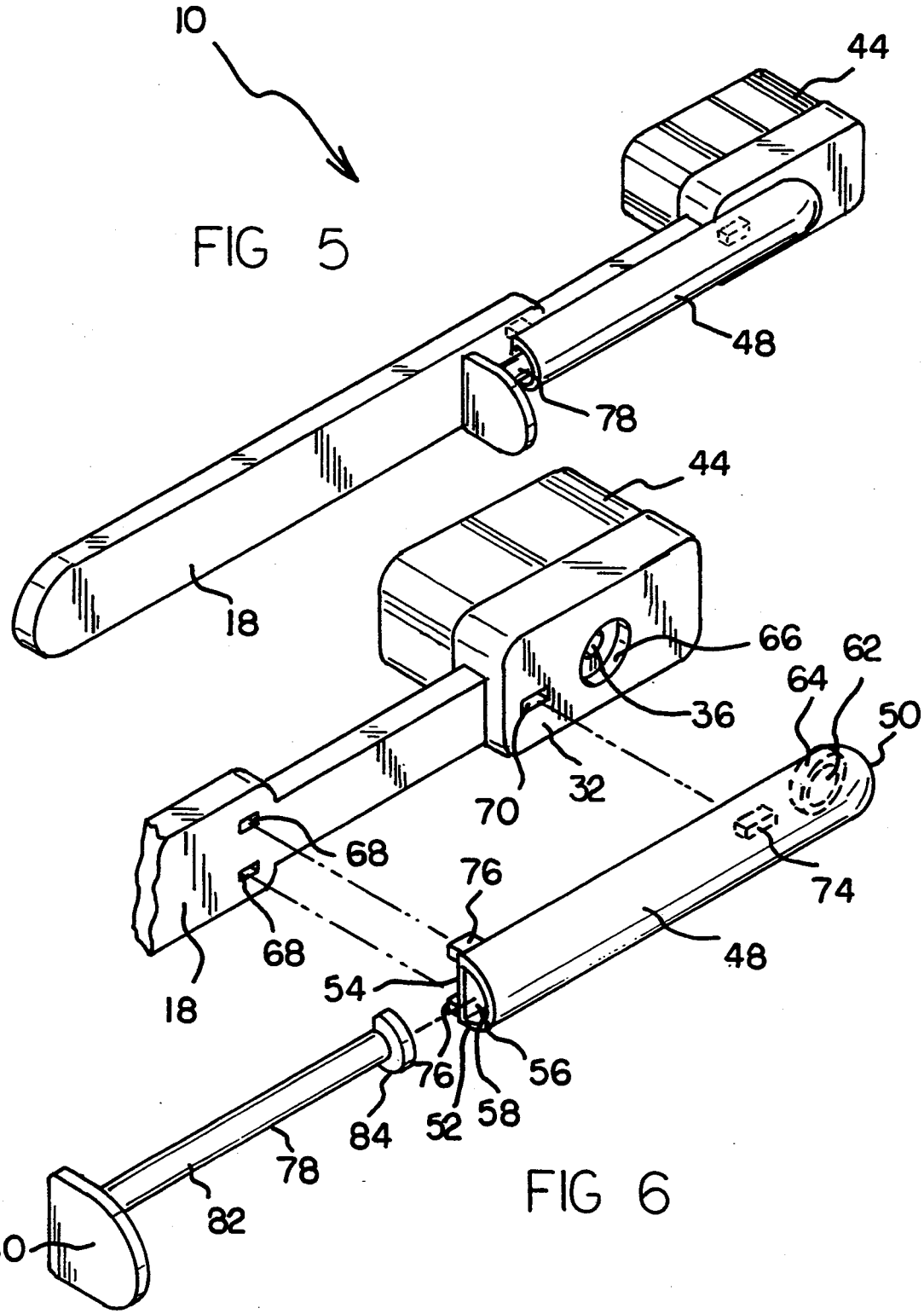
FIG. 5 is a perspective view of the toothbrush in accordance with an alternate embodiment of the invention.
FIG. 6 is a perspective exploded view of the toothbrush in accordance with the alternate embodiment with the dispenser detached and the plunger element removed.
Figure 7:
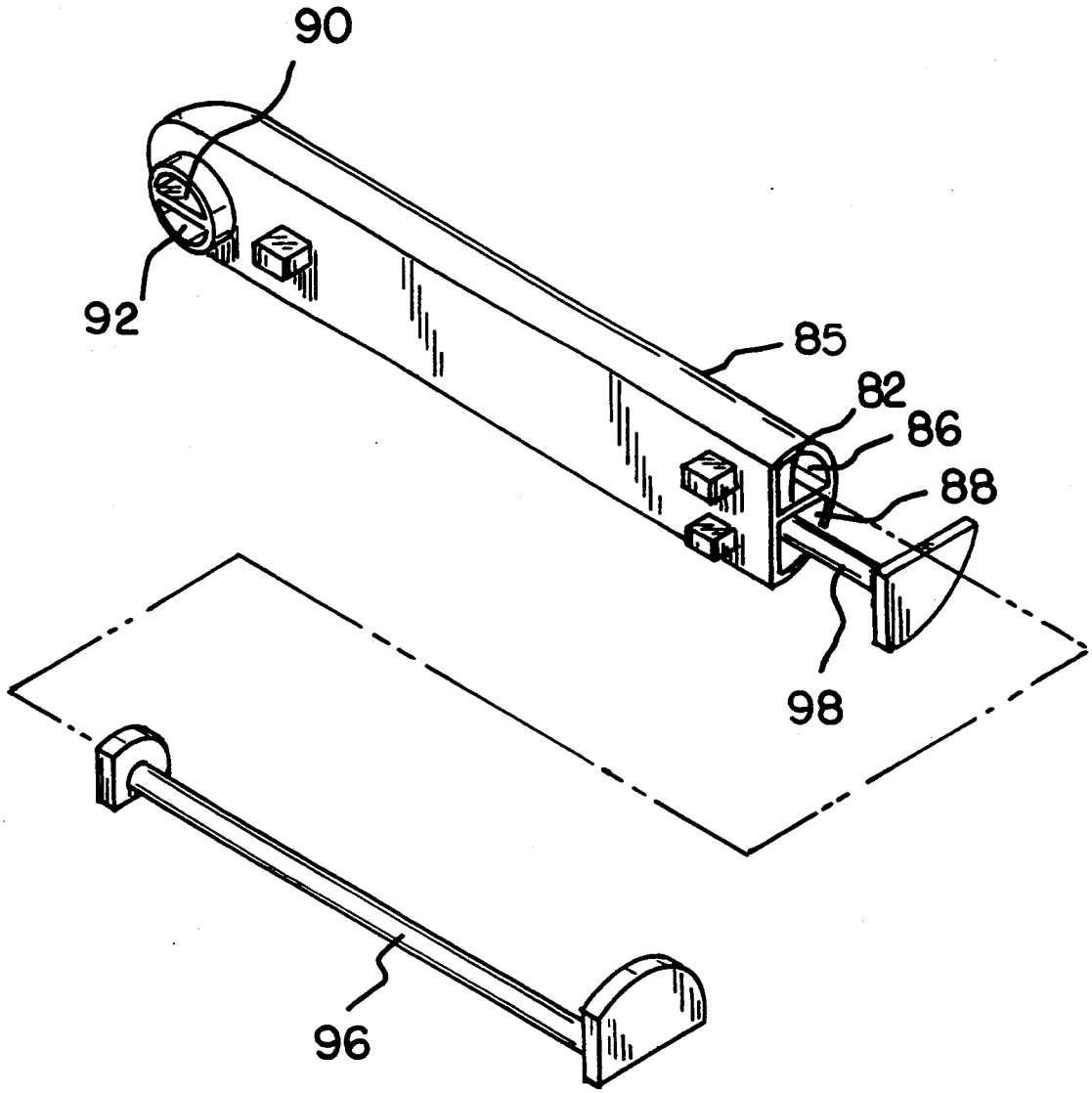
FIG. 7 is a perspective exploded view of the dispenser in accordance with a further alternate embodiment of the invention.

A detachable dispenser can optionally be attached to the bottom surface 18 of the toothbrush 10 in accordance with the alternate embodiment of FIGS. 5 and 6. When attached, the dispenser 48 is used to deliver, by way of the head aperture 36, a quantity of dentifrice to the bristles of the toothbrush. It will be understood that, although dentifrice is specified here, any deformable substance used in conjunction with dental hygiene could be employed within the dispenser, as for example paste, gel or the like.

The dispenser 48 includes a forward end 50, a rearward end 52, a planar bottom surface 54 and a semi-circular upper surface 56. The bottom surface 54 and the upper surface 56 of the dispenser serve to define a hollow interior 58. The hollow interior 58 is adapted to receive a quantity of dentifrice. A circular aperture 62 is formed within the bottom surface 52 of the dispenser at its forward end 50. Surrounding the circular aperture 62, and integral with the bottom surface 54 of the dispenser 48, is a raised circular ring 64. The raised ring 64 is dimensioned and oriented so as to fit within the lower section of the head aperture 36. In this embodiment, the lower section 66 of the head aperture is cylindrical to receive ring 64.

To support the dispensers of this alternate embodiment, a pair of rectangular recesses 68 are formed within the bottom surface 18 of the handle intermediate it forward and rearward ends. The rectangular recesses 68 are adjacent and parallel to one another and have longitudinal axes which are parallel to the longitudinal axis of the handle. The pair of rectangular recesses serve to secure the detachable dispenser 48 to the bottom of the toothbrush.

A rectangular recess 70 is formed within the bottom surface 32 of the head portion 24 at its rearward end. The rectangular recess 70 has a longitudinal axis which is coincident with the longitudinal axis of the head. The rectangular recess 70 is employed in conjunction with the pair of recesses 68 of the handle and serves to secure a detachable dispenser 48 to the bottom of the toothbrush.

Three protruding tabs 74 and 76 are employed in securing the dispenser to the bottom of the toothbrush. The three protruding tabs are integral with the bottom surface of the dispenser. A first protruding tab 74 is located at the forward end of the dispenser. The first protruding tab has a longitudinal axis which is coincident with the longitudinal axis of the dispenser. Additionally, a pair of protruding tabs 76 are located at the rearward end of the dispenser. The pair of protruding tabs are adjacent and parallel to one another and have a longitudinal axes which are parallel to the longitudinal axis of the handle.

The dispenser 48 can be secured to the toothbrush by positioning the raised circular ring 64 within the circular aperture 66 of the head portion, positioning the first protruding tab 74 within the rectangular recess 70 of the head portion, and positioning the pair of protruding tabs 76 within the rectangular recesses 68 of the handle portion. With the securement as described, the longitudinal axis of the dispenser is coincident with the longitudinal axis of the toothbrush. Once the dispenser is secured to the toothbrush the dispenser is in fluid communication with the bristles of the toothbrush.

In order to facilitate the displacement of dentifrice a plunger element 78 is positioned within the hollow interior portion of the dispenser. The plunger element includes a button 80 to be engaged by the finger of the operator, a shaft, 82, and a piston 84. The length of the shaft is approximately equal to the length of the dispenser, and the piston is of a shape to sealingly engage the interior of the dispenser.

The use of the toothbrush, as heretofore described, is as follows. Toothpaste is injected into the dispenser 48 by way of its open rearward end or the aperture 62. Once a supply of dentifrice is placed within the hollow interior 58 of the dispenser it can then be secured to the toothbrush as previously described. The plunger element 78 can then be employed to force the dentifrice through the circular aperture 62 of the dispenser, the circular aperture 36 of the head portion, and then up into the bristles 44 of the toothbrush.

The toothbrush of the third embodiment is substantially the same as that of the second with the exception of the dividing wall 82 formed centrally within the hollow interior of the detachable dispenser 85. The dividing wall serves to define first and second hollow interior portions 86 and 88. The first and second interior portions are sealed from one another. Each portion, however, is in fluid communication with the apertures 90 and 92 of the dispenser, the aperture of the head portion, and the bristles. Within each of the hollow interior portions is positioned a plunger element 96 and 98. The plunger elements are substantially the same as in the first embodiment. Thus, in use, the dispenser can be initially injected with two different dentifrice, one for cleaning, one for fragrance. Due to the two plunger elements, two different quantities can be dispensed in individually controlled amounts.

As to the manner of usage and operation of the present invention, the same :should be apparent from the above description. Accordingly, no further discussion relating to the manner of usage and operation will be provided. It should be noted that the simplicity of design of the various embodiments makes it an improved toothbrush, not only for humans, but also for animals such as dogs, cats and the like.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothbrush comprising:

a handle portion having a forward end, a rearward end, a top surface, and a bottom surface;

a head portion having a forward end, a rearward end, a top surface and a bottom surface, the rearward end of the head portion being integral with the forward end of the handle portion, the head portion having a circular aperture;

a plurality of bristles, the bristles having an upper extent and a lower extent, the lower extent of the bristles being attached to the top surface of the head portion;

a detachable dispenser, the dispenser having a forward end, a rearward end, a planar bottom surface, and a semi-circular upper surface, the bottom surface and the upper surface serving to define a hollow interior portion, the dispenser apertures located within the bottom surface at the forward end of the dispenser;

means for removably securing the planar bottom surface of the detachable dispenser to the bottom surfaces of the head and handle portions such that the apertures of the detachable dispenser and the circular aperture of the head portion are in fluid communication;

a dividing wall positioned within the hollow interior portion of the detachable dispenser;

first and second hollow interior portions defined by the dividing wall the portions each being of a common cross sectional configuration between the forward end and the apertures adjacent to the rearward end and a pair of independently reciprocable plungers slidable within the hollow interior portions.

* * * * *